US009475314B2

(12) United States Patent
Kojima et al.

(10) Patent No.: US 9,475,314 B2
(45) Date of Patent: Oct. 25, 2016

(54) PRINTING DEVICE AND PRINTING METHOD

(71) Applicant: SEIKO EPSON CORPORATION, Tokyo (JP)

(72) Inventors: Kenji Kojima, Fujimi-machi (JP); Nobuaki Nagae, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/604,946

(22) Filed: Jan. 26, 2015

(65) Prior Publication Data

US 2015/0239266 A1 Aug. 27, 2015

(30) Foreign Application Priority Data

Feb. 24, 2014 (JP) ..... 2014-032573

(51) Int. Cl.

| | |
|---|---|
| ***B41J 11/46*** | (2006.01) |
| ***B41J 11/14*** | (2006.01) |
| ***B41J 15/04*** | (2006.01) |
| ***B41J 11/06*** | (2006.01) |

(52) U.S. Cl.

CPC ..... *B41J 11/06* (2013.01); *B41J 11/14* (2013.01); *B41J 15/04* (2013.01)

(58) Field of Classification Search

CPC ..... B41J 15/00; B41J 15/16; B41J 15/005; B41J 15/046; B41J 11/22; B41J 11/46; B41J 11/06; B41J 11/14

USPC ..... 347/104, 37

See application file for complete search history.

(56) References Cited

U.S. PATENT DOCUMENTS

| | | | | |
|---|---|---|---|---|
| 2003/0107640 | A1* | 6/2003 | Chang | B41J 11/008 347/107 |
| 2004/0075708 | A1 | 4/2004 | Arakawa | |
| 2009/0016785 | A1* | 1/2009 | Haan | G03G 15/0131 399/301 |
| 2011/0012294 | A1* | 1/2011 | Kiuchi | G03F 7/70791 264/446 |

FOREIGN PATENT DOCUMENTS

| | | | |
|---|---|---|---|
| JP | 2004-188954 | A | 7/2004 |
| JP | 3640868 | B2 | 4/2005 |
| JP | 2009-276522 | A | 11/2009 |
| JP | 2010-042678 | A | 2/2010 |
| JP | 2011-022584 | A | 2/2011 |
| JP | 2011-022585 | A | 2/2011 |

* cited by examiner

*Primary Examiner* — Geoffrey Mruk
*Assistant Examiner* — Scott A Richmond
(74) *Attorney, Agent, or Firm* — Global IP Counselors, LLP

(57) ABSTRACT

A printing device has an elongated shaped work divided into a preceding printing area and a following printing area along an elongated direction, and is configured to perform printing in the sequence of the preceding printing area and the following printing area. With the printing device, when performing printing on the following printing area, a feature point of the preceding printing area is extracted, and based on the extracted feature point, the position of the following printing area is adjusted, and printing is started on the following printing area.

11 Claims, 11 Drawing Sheets

PRINTING DEVICE AND PRINTING METHOD

CROSS-REFERENCE TO RELATED APPLICATIONS

This application claims priority to Japanese Patent Application No. 2014-032573 filed on Feb. 24, 2014. The entire disclosure of Japanese Patent Application No. 2014-032573 is hereby incorporated herein by reference.

BACKGROUND

1. Technical Field

The present invention relates to a printing device and a printing method.

2. Related Art

Pattern forming devices that implement a designated pattern on a sheet material having a long shape are known (see Unexamined Patent Publication No. 2011-22585, for example). The pattern forming device noted in this Unexamined Patent Publication No. 2011-22585 is equipped with an outlet roll for letting out the sheet material, a winding roll for winding the sheet material let out from the outlet roll, a stage arranged between the outlet roll and the winding roll, and a projection optical system for forming a pattern image on the sheet material supported on the stage. Also, it is possible to form the pattern in sequence on the sheet member. Specifically, after one designated pattern (hereafter this is called the "preceding pattern") is formed on the stage, the sheet member is let out, and adjacent to that preceding pattern, another one designated pattern (hereafter called the "following pattern") is formed.

However, the sheet material is a long body that is flexible, so when it is conveyed, it may stretch out or be wrinkled. Because of that, there are cases when there is a difference between the positional relationship of the projection optical system and the sheet material when forming the preceding pattern and the positional relationship of the projection optical system and the sheet material when forming the following pattern. In this case, for example, a problem occurs of the following pattern not being formed in the correct position on the sheet material.

SUMMARY

An object of the present invention is to provide a printing device and a printing method that, when printing is performed in a following printing area after printing is implemented on a preceding printing area of the recording medium, can performing printing accurately in that following printing area.

This kind of object is achieved using the present invention noted below.

The printing device of one aspect of the invention comprises an outlet roll configured to let out recording medium having an elongated shape, a winding roll configured to wind the recording medium and arranged downstream in a conveyance direction in which the recording medium is let out and conveyed in relation to the outlet roll, a stage arranged between the outlet roll and the winding roll and configured to be in a fixed state for which the recording medium is fixed, and a cancelled state for which that fixed state has been cancelled, a stage support unit supporting the stage such that the stage moves along at least a y axis direction of surface directions on the stage, when a direction orthogonal to the conveyance direction is used as an x axis direction, a direction parallel to the conveyance direction is used as the y axis direction, and a direction orthogonal to both the x axis direction and the y axis direction is used as a z axis direction, a printing unit configured to, in the fixed state, divide the recording medium into a preceding printing area and a following printing area along the y axis direction, and perform printing in the sequence of the preceding printing area and the following printing area, and an extraction unit configured to extract a preceding feature point of the preceding printing area. When the printing is performed in the following printing area, a relative positional relationship of the printing unit and the following printing area is adjusted based on the preceding feature point extracted by the extraction unit, and the printing is started on the following printing area.

By doing this, when performing printing in the following printing area after printing is implemented in the preceding printing area of the recording medium, it is possible to perform printing accurately in that following printing area.

With the printing device of another aspect of the invention, preferably, an adjustment of the positional relationship is performed by having the stage in the fixed state moved along the y axis direction by the stage support unit.

By doing this, it is possible easily perform an adjustment of the positional relationship.

With the printing device of another aspect of the invention, preferably, the stage is rotatably supported around the z axis by the stage support unit, and an adjustment of the positional relationship is performed by having the stage in the fixed state rotated around the z axis by the support unit.

By doing this, it is possible to easily perform an adjustment of the positional relationship.

With the printing device of another aspect of the invention, it is preferable that the printing device further comprise a printing unit support unit configured to support the printing unit such that the printing unit moves along the x axis direction, and an adjustment of the positional relationship be performed by skewing a timing for starting the printing of the printing unit.

By doing this, it is possible easily perform an adjustment of the positional relationship.

With the printing device of another aspect of the invention, preferably, the extraction unit is further configured to extract a following feature point of the following printing area, and when performing the printing on the following printing area, the positional relationship is adjusted based on the preceding feature point and the following feature point extracted by the extraction unit, and the printing is started on the following printing area.

By doing this, it is possible to perform printing more accurately on the following printing area.

With the printing device of another aspect of the invention, preferably, of adjustments of positional relationship, an adjustment of the x axis direction positional relationship is based on the following feature point extracted by the extraction unit, an adjustment of the y axis direction positional relationship is based on the preceding feature point extracted by the extraction unit, and an adjustment of the positional relationship around the z axis is based on the following feature point extracted by the extraction unit.

By doing this, it is possible to easily perform an adjustment of the positional relationship, and possible to perform printing more accurately on the following printing area.

With the printing device of another aspect of the invention, preferably, the following feature point is an edge part positioned in the x axis direction of the recording medium.

By doing this, it is possible to omit separately providing the following feature point on the recording medium.

With the printing device of another aspect of the invention, preferably, the preceding feature point is a marker added to the preceding printing area.

By doing this, for example, it is possible to have the preceding feature point not stand out using other printing within the preceding printing area.

With the printing device of another aspect of the invention, preferably, the marker is added by printing.

By doing this, for example, it is possible to add the preceding feature point together with other printing within the preceding printing area, and thus it is possible to omit separately providing a device or step for adding the preceding feature point.

With the printing device of another aspect of the invention, preferably, the preceding feature point further serves as a reference position when the recording medium is cut between the preceding printing area and the following printing area.

By doing this, it is possible to accurately cut the recording medium into the preceding printing area and the following printing area.

With the printing device of another aspect of the invention, preferably, the extraction unit has at least one imaging unit configured to capture an image of the preceding feature point.

By doing this, it is possible to easily detect the preceding feature point using a relatively simple method of imaging an image.

With the printing device of another aspect of the invention, preferably, a plurality of imaging units are arranged separated along the y axis direction.

By doing this, it is possible to do imaging of the recording medium image in as broad a range as possible.

With the printing device of another aspect of the invention, preferably, the printing device further comprises an imaging unit supporting unit configured to support the imaging unit such that the imaging unit moves in the x axis direction.

By doing this, it is possible to suitably adjust the position of the imaging unit according to the length of the recording medium x axis direction.

The printing method of another aspect of the present invention is a printing method for which a recording medium having an elongated shape is divided into a preceding printing area and a following printing area along an elongated direction, and printing is performed in the sequence of the preceding printing area and the following printing area. The printing method comprises, when performing printing on the following printing area, extracting a feature point of the preceding printing area, adjusting a position of the following printing area based on the extracted feature point, and starting printing on the following printing area.

By doing this, when performing printing on the following printing area after implementing printing on the preceding printing area of the recording medium, it is possible to perform accurate printing on that following printing area.

BRIEF DESCRIPTION OF THE DRAWINGS

Referring now to the attached drawings which form a part of this original disclosure.

DETAILED DESCRIPTION OF EXEMPLARY EMBODIMENTS

Following, we will give a detailed description of the printing device and the printing method of the present invention based on preferred embodiments shown in the attached drawings.

First Embodiment

Figure 1:
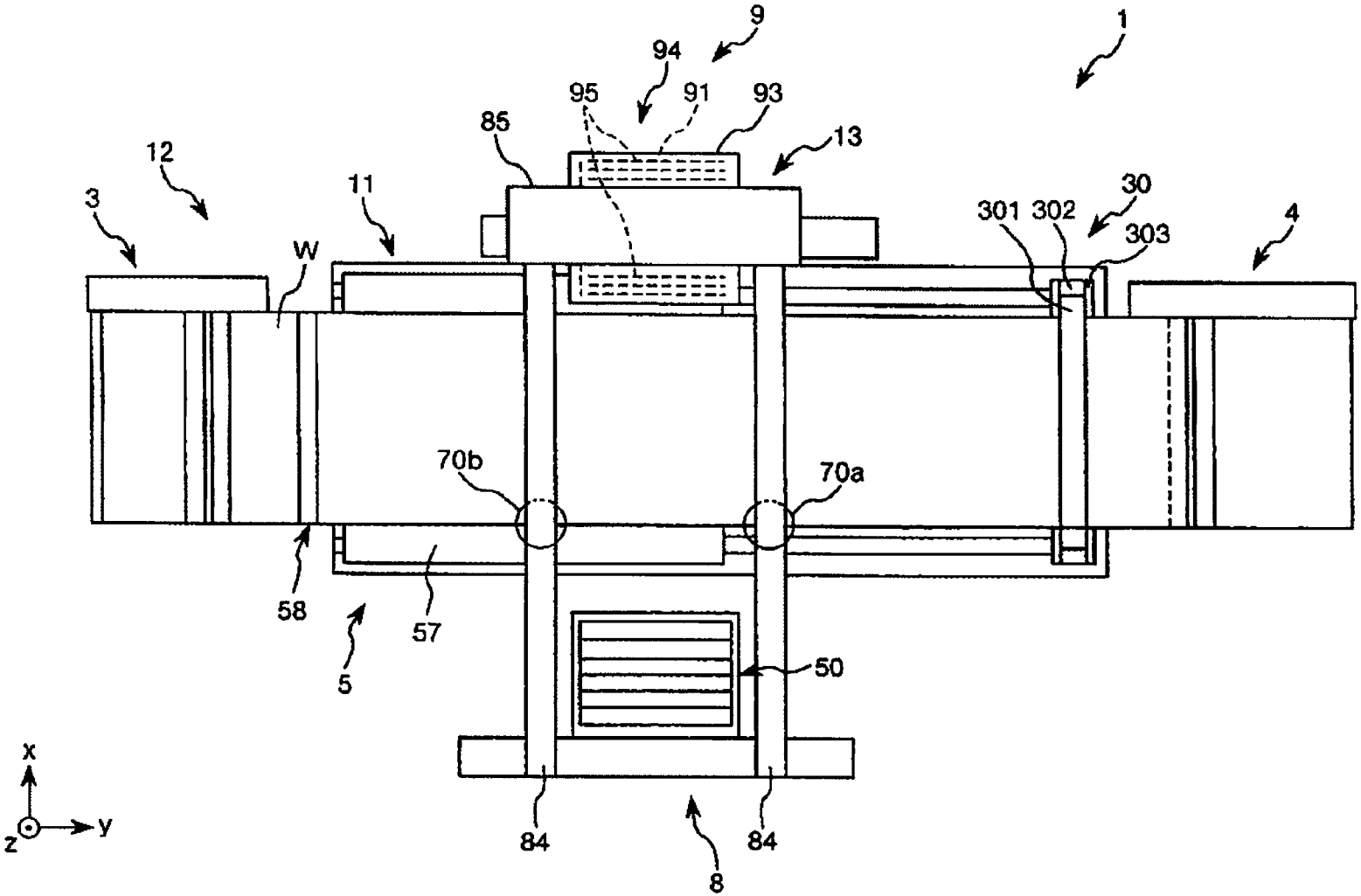
FIG. 1 is a plan view showing the first embodiment of the printing device of the present invention.
Figure 2:
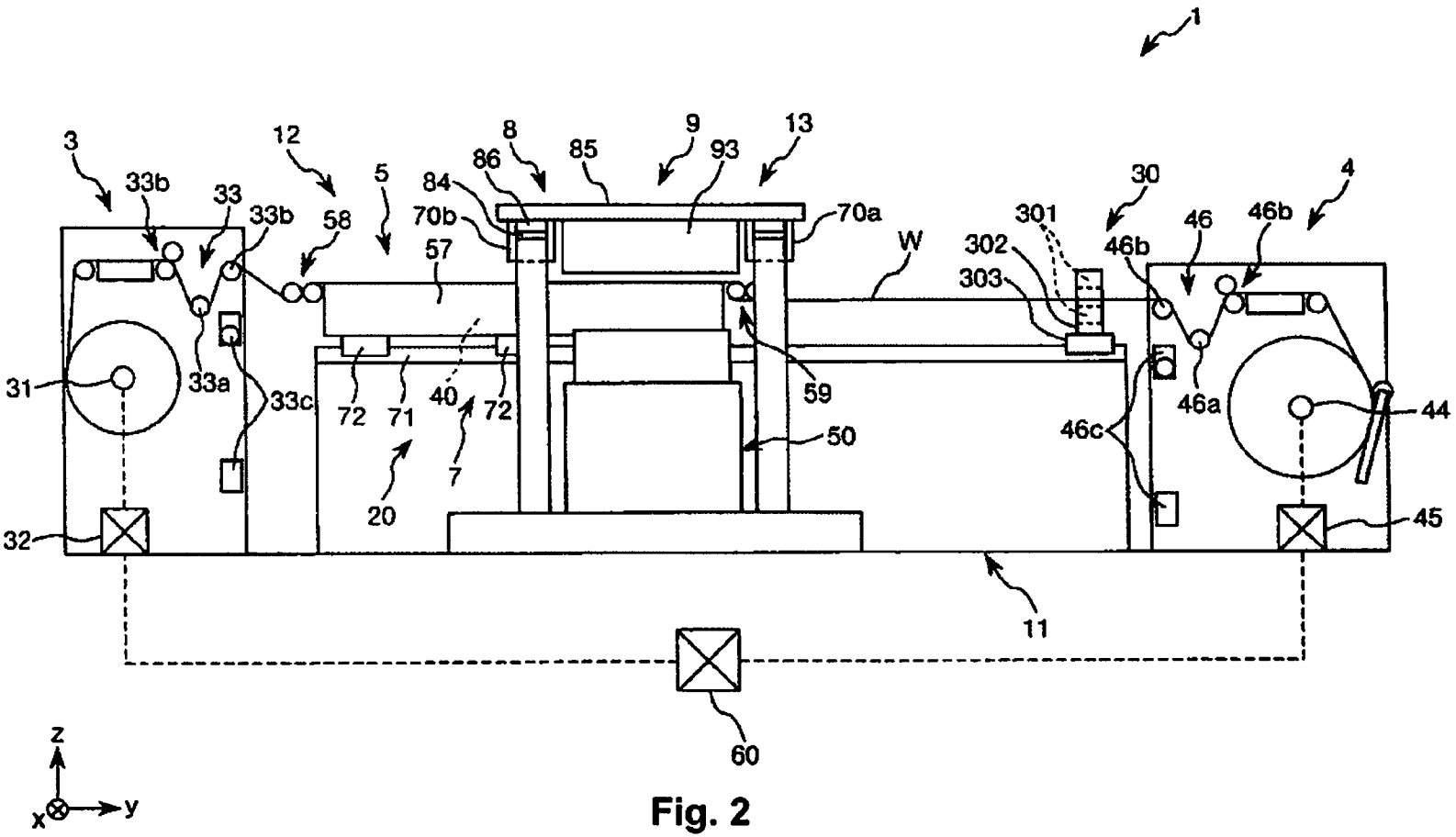
FIG. 2 is a side view of the printing device shown in FIG. 1.
Figure 12:
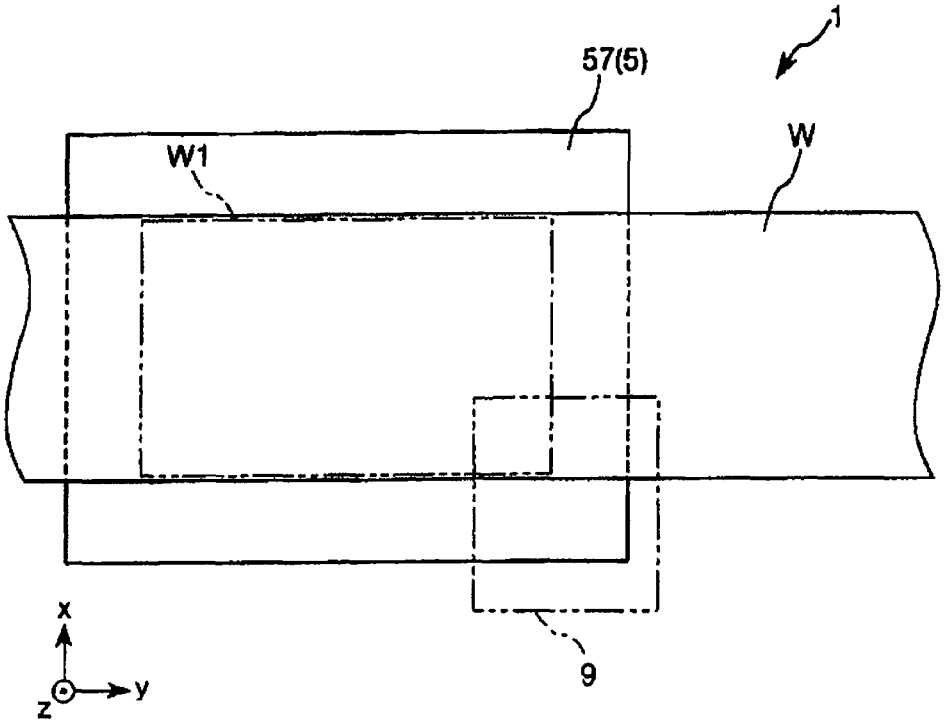
FIG. 12 is a drawing seen from the arrow A direction in FIG. 3.
Figure 13:
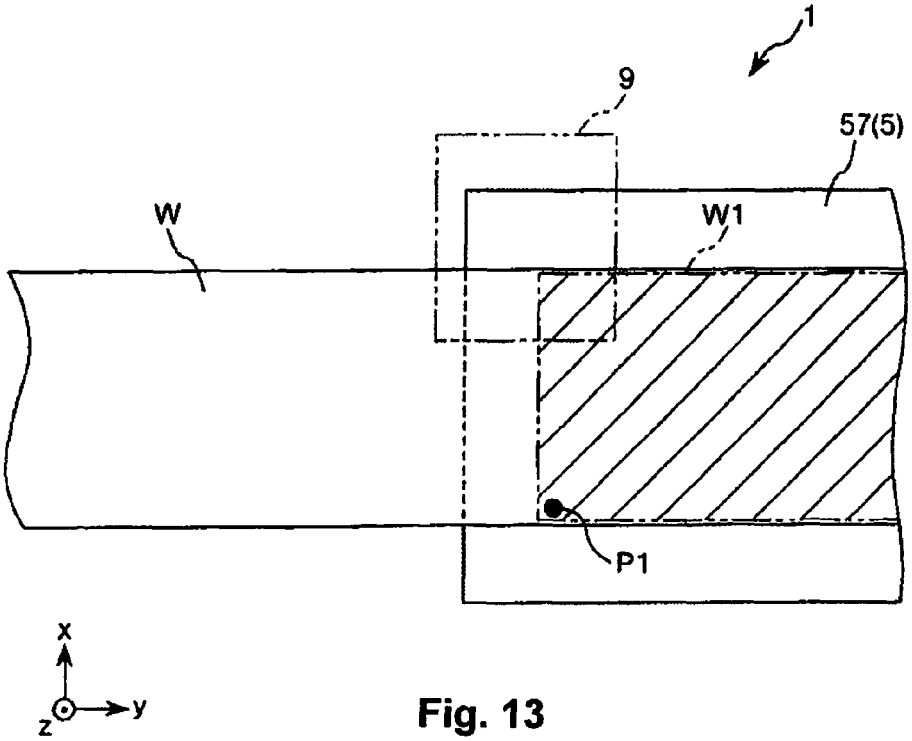
FIG. 13 is a drawing seen from the arrow B direction in FIG. 7.
Figure 14:
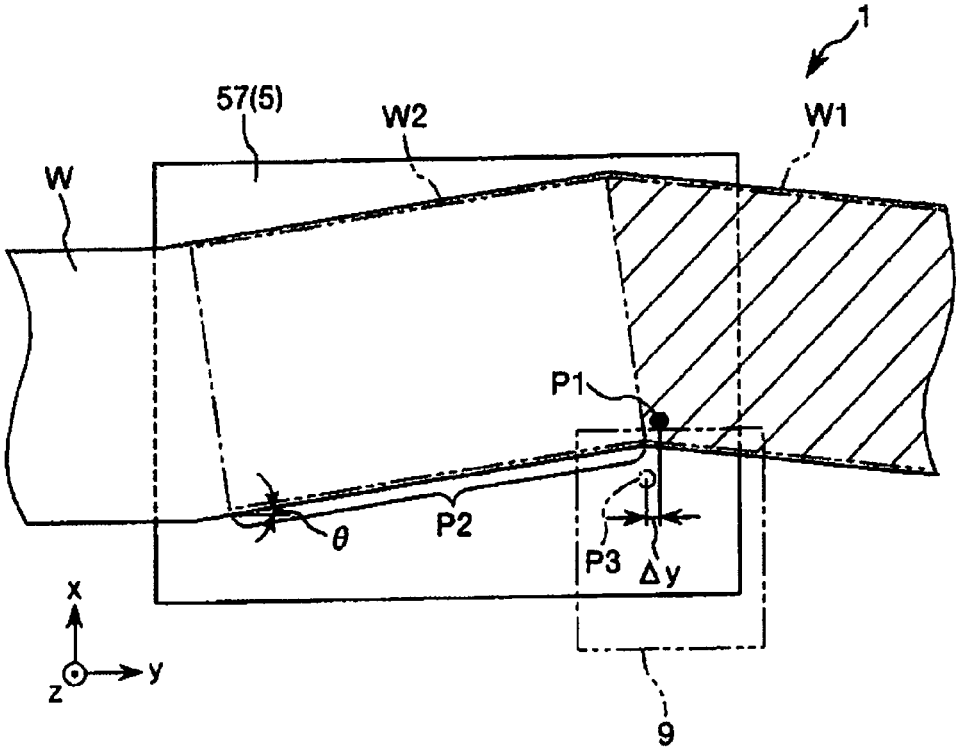
FIG. 14 is a drawing seen from the arrow C direction in FIG. 10.
Figure 15:
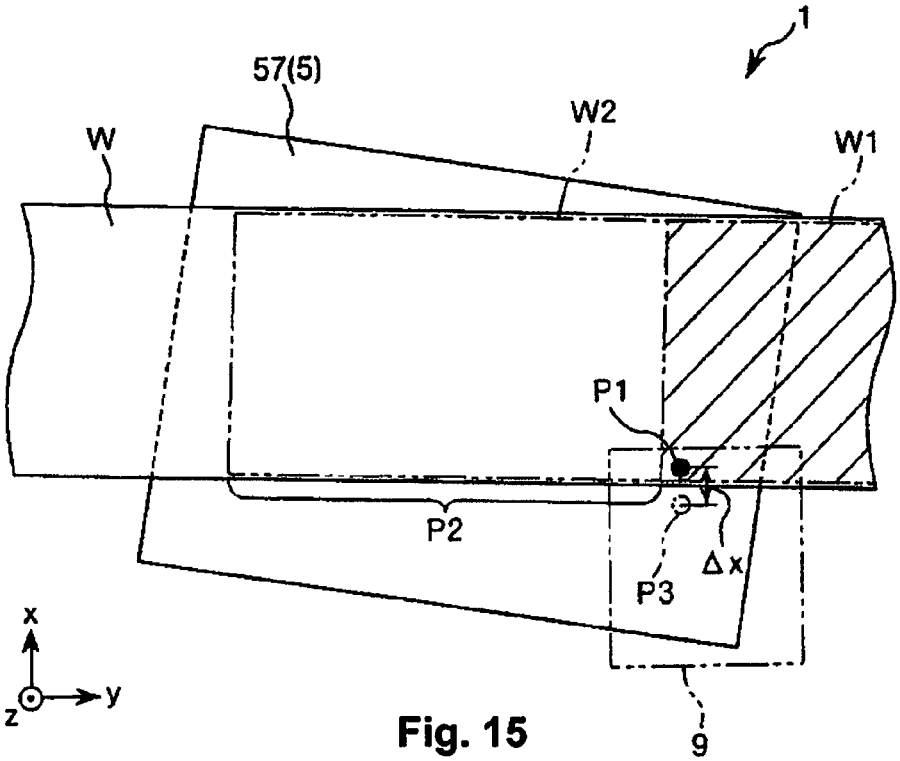
FIG. 15 is a drawing showing the state after the positional relationship is adjusted from the state shown in FIG. 14.
Figure 16:
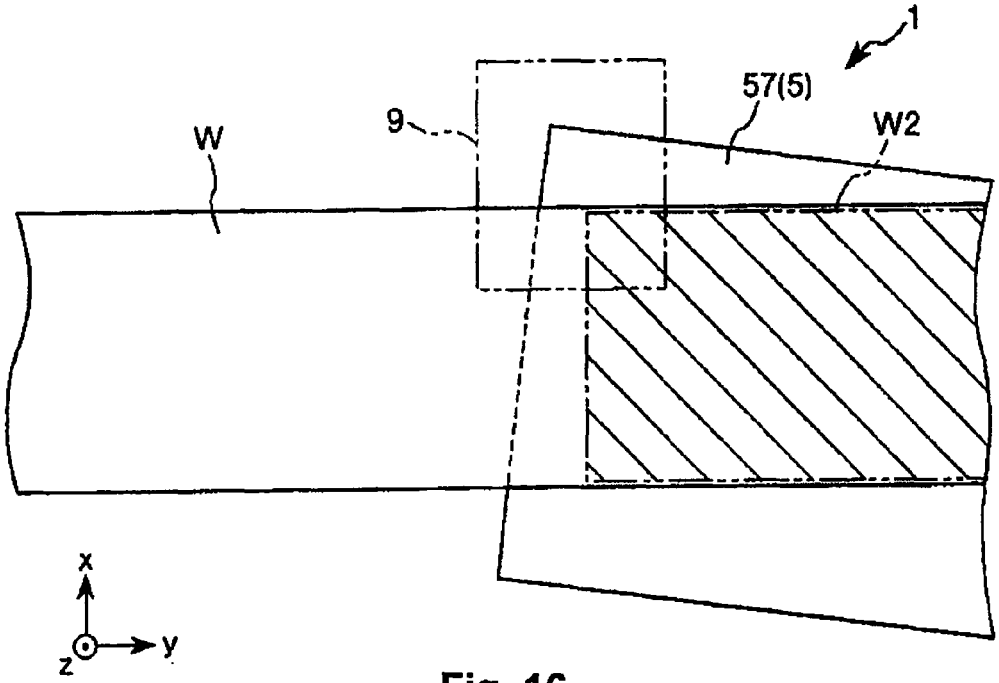
FIG. 16 a drawing showing the state of the printing completed from the state shown in FIG. 15.
Figure 17:
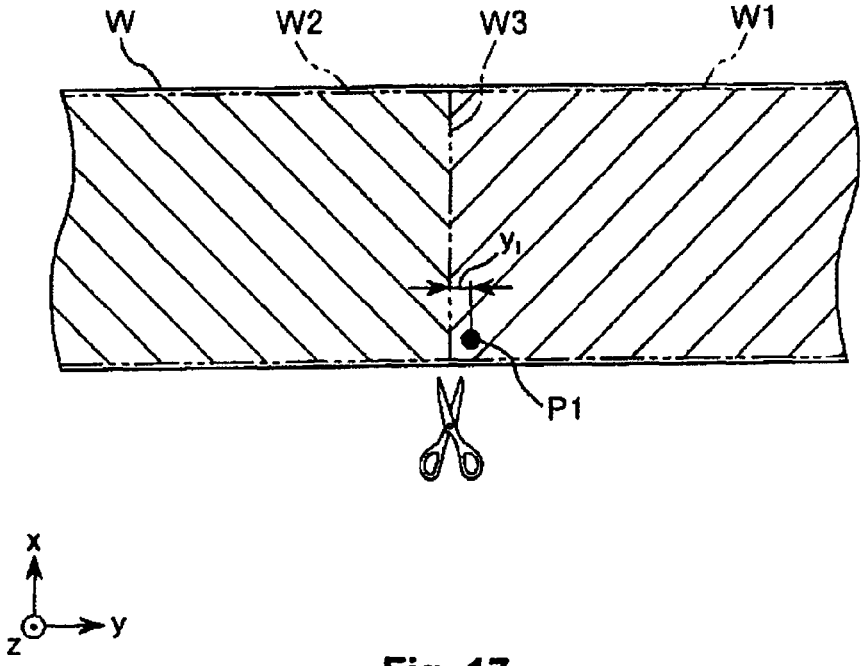
FIG. 17 is a drawing showing the cutting state.

FIG. 1 is a plan view showing a first embodiment of the printing device of the present invention. FIG. 2 is a side view of the printing device shown in FIG. 1. FIG. 3 through FIG. 11 are respectively side views showing the operating state in sequence of the printing device shown in FIG. 1. FIG. 12 is a drawing seen from the arrow A direction in FIG. 3. FIG. 13 is a drawing seen from the arrow B direction in FIG. 7. FIG. 14 is a drawing seen from the arrow C direction in FIG. 10. FIG. 15 is a drawing showing the state after adjustment of the positional relationship from the state shown in FIG. 14. FIG. 16 is a drawing showing the state for which printing has been completed form the state shown in FIG. 15. FIG. 17 is a drawing showing the cutting state. Hereafter, for the convenience of the description, the vertical direction in FIG. 1 will be called the "x axis direction," the lateral direction will be called the "y axis direction," and the paper surface depth direction will be called the "z axis direction." Also, the coordinate axes in FIG. 2 through FIG. 17 (the same is also true for FIGS. 18A-18C) respectively correspond to the coordinate axes in FIG. 1. Also, with FIG. 14, the skew of the positional relationship is depicted in exaggerated form.

As shown in FIG. 1 and FIG. 2, the printing device 1 is equipped with a conveyance mechanism (conveyance means) 12 for conveying work W as a recording medium, and a printing mechanism (printing means) 13 for implementing printing on the work W.

The conveyance mechanism 12 is equipped with a delivery device 3 for delivering long work W rolled in to roll form, a winding device 4 for winding the work W that has already been printed, a work stage 5 arranged on a machine platform 11, on which the fed work W is set by suction, a stage support device (stage support unit) 20 for supporting the work stage 5, and a work holding device 30 provided at the y axis direction downstream side of the work stage 5, that grips and fixes the work W.

With this embodiment, of the surface directions on the work stage 5, the direction orthogonal to the conveyance direction in which the work W is conveyed is the x axis direction, the direction parallel to the conveyance direction is the y axis direction, and the direction orthogonal to the x axis direction and the y axis direction is the z axis direction.

Also, the stage support device 20 extends in the y axis direction, and is equipped with a y axis table 7 that intermittently sends the work W in the y axis direction via the work stage 5, and a stage rotation mechanism 40 that rotates the work stage 5 around the z axis.

The printing mechanism 13 is equipped with a carriage unit 9 having a plurality of inkjet heads (printing unit) 91 for performing printing on the work W by discharging ink, and an x axis table (printing unit support unit 8) extended in the x axis direction so as to straddle the y axis table 7 of the stage support device 20, for supporting the carriage unit 9 to be able to move in the x axis direction.

Furthermore, the printing device 1 is equipped with a maintenance device 50 consisting of a suction unit that forcefully exhausts ink from teach inkjet head 91 and a wiping unit for wiping the nozzle surface, and a control device 60 for controlling cameras 70*a* and 70*b* as imaging units for imaging the work W on the work stage 5, and each part of the printing device 1. The maintenance device 50 is arranged in a maintenance area separated in the x axis direction away from the printing area that the y axis table 7 and x axis table 8 intersect, and performs maintenance of the inkjet heads 91 facing the maintenance area.

With this printing device 1, the work W is divided into a preceding printing area W1 and a following printing area W2 along the y axis direction, and it is possible to perform printing in the sequence of the preceding printing area W1 and the following printing area W2 (see FIG. 12 to FIG. 16).

Specifically, with the printing device 1, after the work W delivered by the delivery device 3 is put to a fixed state by suction with the work stage 5, ink is discharged from the inkjet heads 91 while the work W is intermittently fed in the y axis direction (sub scan) via the work stage 5 by the y axis table 7, and the carriage 9 is moved back and forth in the x axis direction (main scan) in relation to the preceding printing area W1 of the work W in a fixed state. This is performed until printing on the preceding printing area W1 is completed. Subsequently, printing is performed on the following printing area W2 positioned to the rear of the preceding printing area W1 (y axis direction upstream side). This printing is the same as the printing on the preceding printing area W1.

Following, we will describe the constitution of each part.

The delivery device 3 is arranged at the upstream side of the feed direction (y axis direction) of the work W by the machine platform 11. The delivery device 3 is equipped with a delivery reel (outlet roll) 31 that winds the work W into roll form and lets out that work W, a delivery motor 32 that does delivery rotation of the delivery reel 31, and a delivery side buffer mechanism 33 that bends the delivered work W into a V shape in the z axis direction, and gives light back tension to the work W.

As shown in FIG. 2, the delivery side buffer mechanism 33 has a delivery side dancer roller 33*a* that can move in the z axis direction so as to always give back tension to the work W, delivery side guide rollers 33*b* provided individually at the upstream side and the downstream side of the delivery side dancer roller 33*a*, and a pair of upper and lower delivery side sensors 33*c* that detect the z axis direction position of the delivery side dancer roller 33*a*. The upstream side delivery side guide roller 33*b* is a nip roller.

Figure 4:
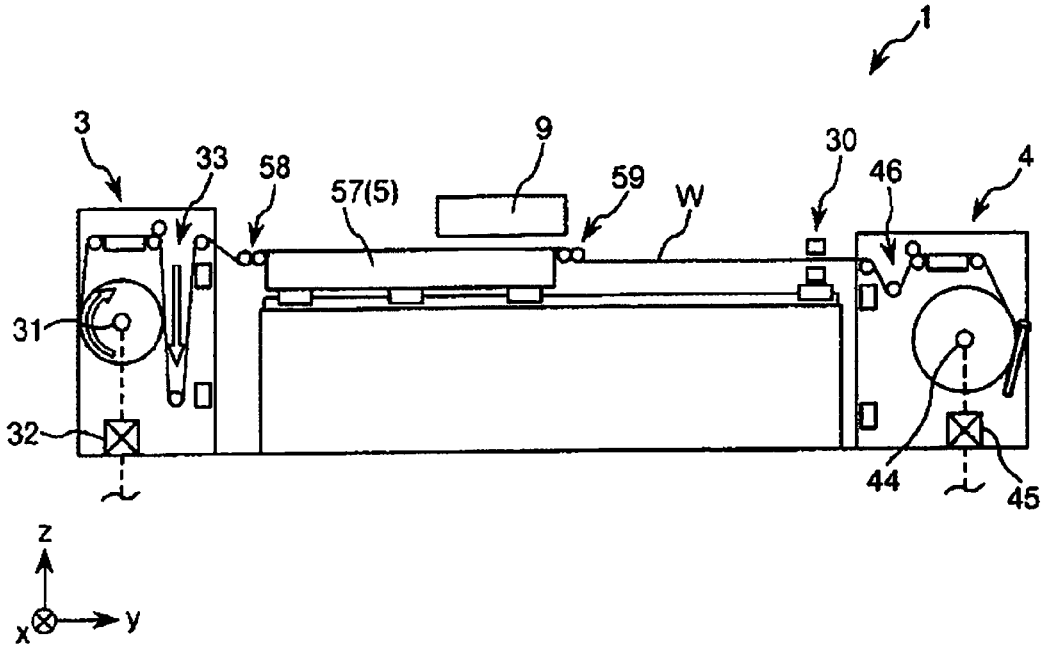
FIG. 4 is a side view showing the operating state in sequence of the printing device shown in FIG. 1.
Figure 5:
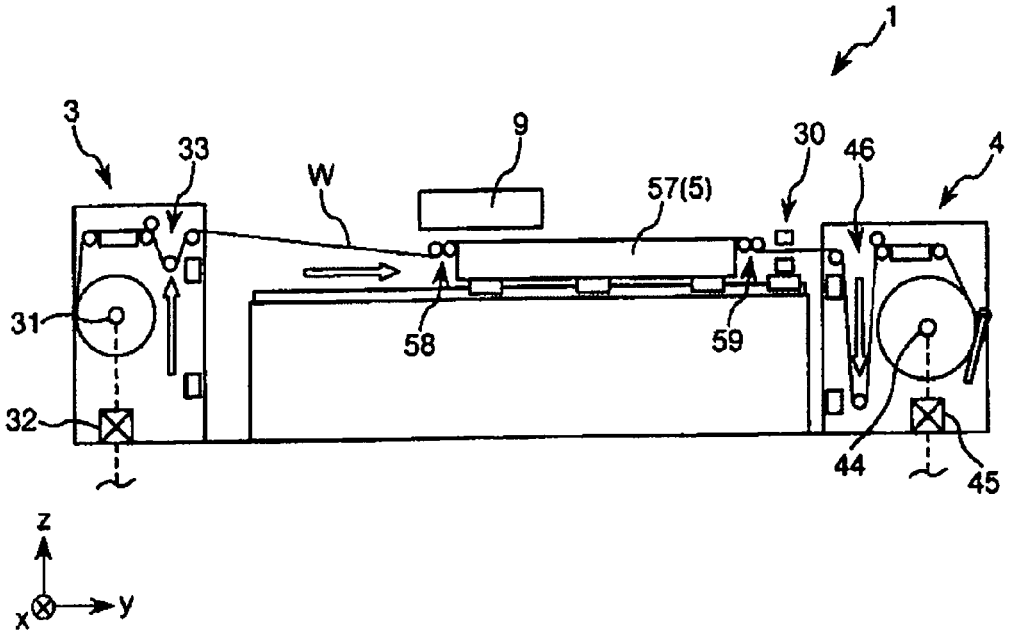
FIG. 5 is a side view showing the operating state in sequence of the printing device shown in FIG. 1.

The length of the work W maintained by the delivery side buffer mechanism 33 is set to a length of the work stage 5 movement distance or greater (see FIG. 4). With this embodiment, so as to be able to maintain this work W length, the delivery motor 32 is driven by the detection of the upper limit side delivery side sensor 33*c*, and the delivery motor 32 is stopped by detection of the lower limit side delivery side sensor 33*c*. By doing this, it is possible to deliver the necessary volume of work W. Also, by absorbing the work W using the delivery side buffer mechanism 33, when performing the recording operation a plurality of times on one printing area, it is possible to omit winding of the work W onto the delivery reel 31 again.

For the work W, it is possible to use a thin film shaped item that is ink absorbent, or a thin film shaped item that is non-ink absorbent. In the former case, examples include regular paper, fine quality paper, and inkjet recording specialized papers such as glossy paper or the like, as well as fabric or the like. In the latter case, examples include plastic film that is not surface processed for inkjet printing (specifically, does not have an ink absorbing layer formed), as well as items for which plastic has been coated on a base material of paper or the like, and items to which plastic film has been adhered. As that plastic, though this is not particularly restricted, examples include polyvinyl chloride, polyethylene terephthalate, polycarbonate, polystyrene, polyurethane, polyethylene, and polypropylene.

The winding device 4 is arranged further in the downstream side in the work W feed direction (y axis direction) than the machine platform 11. The winding device 4 is equipped with a winding reel (winding roll) 44 that winds the work W into roll form, a winding motor 45 that does winding rotation of the winding reel 44, and a winding side buffer mechanism 46 that bends the wound work W into a V shape in the z axis direction, and also gives light forward tension to the work W.

As shown in FIG. 2, the winding side buffer mechanism 46 has a winding side dancer roller 46*a* that can move in the z axis direction so as to always give forward tension to the work W, winding side guide rollers 46*b* provided respectively at the upstream side and the downstream side of the winding side dancer roller 46*a*, and a vertical pair of winding side sensors 46*c* for detecting the z axis direction position of the winding side dancer roller 46*a*. The downstream side winding side guide roller 46*b* is a nip roller.

The winding side buffer mechanism 46, the same as with the delivery side buffer mechanism 33, is made to have the winding motor 45 driven by detection of the lower limit side winding side sensor 46*c*, and the winding motor 45 is stopped by detection of the upper limit side winding side sensor 46*c*. By doing this, it is possible to wind the necessary volume of the work W without being affected by the roll diameter of the winding reel 44. By doing this, it is possible to have the work W sent to the downstream side absorbed by the winding side buffer mechanism 46, so it is possible to perform removal of a supplied material without winding the sent work W on the winding reel 44. Also, it is possible to wind the work W onto the winding reel 44 without applying excessive tension on the work W on the work stage 5.

The work stage 5 is arranged between the delivery device 3 and the winding device 4. This work stage 5 has a plurality of holes (not illustrated) formed on the surface, and has a stage main unit 57 for suctioning the work W that is sent from the delivery device 3, a feed roller 58 additionally provided on the work W conveyance direction upstream end part of the stage main unit 57, and an outlet roller 59 additionally provided at the work W conveyance direction downstream end part of the stage main unit 57. The plurality of holes formed on the stage main unit 57 are in communication with vacuum suction equipment and compressed air supply equipment that are both outside the diagrams. Also, by the vacuum suction equipment operating, the work W is suctioned and fixed on the stage main unit 57 via each hole to be in a fixed state. From this fixed state, the operation of the vacuum suction equipment stops, and by operation of the vacuum suction equipment, the work W is released from the stage main unit 57, specifically, is in a cancelled state with the fixed state cancelled.

The work stage 5 has work W which is in a suctioned state at the stage main unit 57 intermittently sent by the y axis table 7 in the y axis direction (from the upstream side to the downstream side). With this embodiment, to draw a plurality of times overlapping on one printing area, when the downstream end position (printing end position) at which the drawing of one printing area part ends is reached, there is a return move to the upstream end position (printing start position) by the y axis table 7.

The feed roller 58 and the outlet roller 59 are respectively constituted with freely rotating nip rollers, and are arranged aligned in the y axis direction. The feed roller 58 and the outlet roller 59 are respectively provided to be able to rise and fall between the falling position which is the position at which their respective top parts roughly match the top surface of the storage main unit 57, and the rising position at which it has risen slightly more than the falling position (by approximately several mm). As the rise and fall mechanism of the feed roller 58 and the outlet roller 59, it is preferable to constitute this using a cylinder (either air pressure or hydraulic is acceptable), or a motor and rack and pinion or the like.

The work W is transferred to the top surface of the stage main unit 57 in a state sandwiched between the feed roller 58 and the outlet roller 59. The feed roller 58 and the outlet roller 59 are capable of suction holding the work W (printing area) on the top surface of the stage main unit 57 by moving to the falling position, and on the other hand, by that suction hold being released (vacuum suction is stopped) and compressed air being supplied between the work W and the stage main unit 57, and moving to the rising position, the work W is slightly floated upward. By doing this, it is possible to have material removed or material supplied from the top surface of the stage main unit 57 without applying unreasonable tension on the work W. Also, the printing area is separated (lifted) from the work stage 5, so it is possible to remove supplied material without causing damage such as scratches or the like on the work W.

The feed roller 58 and the outlet roller 59 that exist in the falling position are aligned in the y axis direction, and are constituted to roughly match the surface with the top surface of the stage main unit 57. Because of this, it is possible to maintain the work W flatness degree not only in the area suction-held on the stage main unit 57, but also in the space from the position at which the feed roller 58 is sandwiched to the position at which the outlet roller 59 is sandwiched. Specifically, it is possible to ensure as wide a printing area as possible. Also, when the feed roller 58 and the outlet roller 59 rise and fall, of the feed roller 58 and the outlet roller 59, after one of rising or falling starts, it is preferable to have the other rise or fall start with a delay. By doing this, when moving to the falling position, air is made to be pushed between the work W and the stage main unit 57 and it is possible to adhere the work W on the stage main unit 57, and possible to ensure good suction holding.

The y axis table 7 has a pair of y axis guide rails 71 arranged on the machine platform 11 and extending in the y axis direction, and a motor driven y axis slider 72 that supports the work stage 5 to be able to slide freely along the y axis guide rails 71. The y axis table 7 stops when the carriage unit 9 (each inkjet head 91) moves forward (or moves backward), and until the next backward movement (or forward movement), sends the work W to the y axis direction downstream side by the amount of the printing width. Specifically, the y axis table 7, after printing scanning of the carriage unit 9, intermittently feeds (line feeds) the work stage 5 (work W) by a distance correlating to the printed width. That drive system is preferably constituted by a linear motor or a motor and ball screw mechanism or the like.

The stage rotation mechanism 40 is constituted by a motor and plurality of gear wheels built into the stage main unit 57. Also, by this motor operating, the rotation force of that motor is transmitted to the stage main unit 57 via each gear wheel. By doing this, it is possible for the stage main unit 57 to rotate at a designated angle around the z axis.

The x axis table 8 has a pair of x axis guide rails 84 extended so as to straddle the machine platform 11 in the x axis direction, a bridge plate 85 on which the carriage unit 9 is suspended, and a motor-driven x axis slider 86 that supports the bridge plate 85 to slide freely in the x axis direction. The x axis table 8 moves the inkjet heads 91 back and forth in the x axis direction during printing via the carriage unit 9, and also has the inkjet heads 91 face the maintenance device 50. That drive system is preferably constituted by a linear motor, a motor and ball screw mechanism, or a belt and pulley mechanism or the like.

The carriage unit 9 is equipped with a carriage main unit 93 provided overlapping the bridge plate 85, and a head unit 94 provided overlapping the carriage main unit 93 and having a plurality of inkjet heads 91. A mechanism for rotating the head unit 94 around the z axis is incorporated in the carriage main unit 93. The head unit 94 is constituted to have the plurality of inkjet heads 91 mounted on a head plate (not illustrated), and has a pair of ultraviolet ray lamps 95 mounted on both end parts in the x axis direction of the head plate.

The inkjet head 91 is equipped with a head main unit on which a head internal flow path is formed that is filled with ink inside, and a nozzle plate having a nozzle surface on which many discharge nozzles are opened. On the head main unit, constituted are piezoelectric elements corresponding to each discharge nozzle, and ink droplets are discharged from the discharge nozzles when voltage is applied to piezoelectric elements.

The ink used with this embodiment is so-called ultraviolet-curable ink (UV ink), and the pair of ultraviolet ray lamps 95 mounted on the head unit 94 are lit, and the ultraviolet-curable ink that impacted the work W is cured and fixed.

As shown in FIG. 1 and FIG. 2, the work holding device 30 has a pair of clampers 301 that respectively face the top surface and bottom surface of the work W, a clamp drive mechanism 302 that moves the pair of clampers 301 toward the middle, and a motor-driven clamper slider 303 that supports each clamper 301 and clamp drive mechanism 302 to slide freely along the pair of y axis guide rails 71 described previously. The work holding device 30 uses the winding device 4 vicinity position (y axis direction downstream end) as the home position, and is provided to be able to move to the work stage 5 y axis direction downstream side.

Each clamper 301 is formed at a wider width than the x axis direction width of the work W, and is arranged so as to cut across the work W in the x axis direction, and to face both the front and back surfaces of the work W. The pair of clampers 301 has the surface facing the work W constituted of a flexible material such as rubber or the like, and when the clamp drive mechanism 302 is driven and the work W is gripped from the top and bottom directions, this is made so that relative sliding does not occur, and there are no scratches on the work W.

The clamp drive mechanism 302 has the pair of clampers 301 linked at both end parts, and the pair of clampers 301 are moved with the work W in the center so as to sandwich the work W from the top and bottom directions (moving toward the center). In this way, by moving the pair of clampers 301 to the center, with the conveyance path reaching from the delivery device 3 to the winding device 4, it is possible to stop adding unnecessary tension to the work W without moving the work W in the up and down direction. By doing this, it is possible to prevent work W damage (including stretching), and the occurrence of an error in the movement volume when moving the work W that is gripped by the work holding device 30. That clamp drive mechanism 302 is preferably constituted using a cylinder (either air pressure or hydraulic is acceptable), a motor and rack and pinion or the like.

The clamper slider 303 uses a drive system constituted by a motor and belt mechanism, and moves the supported clampers 301 and clamp drive mechanism 302 back and forth in the y axis direction. The work holding device 30 grips the work W using the pair of clampers 301, and is made to send the work W to the winding device 4 by moving to the y axis direction downstream side using the clamper slider 303. The drive system of the clamper slider 303 can also be constituted from a linear motor, a motor and ball screw mechanism, or other cylinder (either air pressure or hydraulic is acceptable) or the like.

The cameras 70*a* and 70*b* are respectively CCD (Charge Coupled Device) cameras, for example, and can image the work W on the work stage 5. Also, the image data is sent to the control device 60, and image processing is done.

Also, the camera 70*a* is supported on one x axis guide rail 84 of the two x axis guide rails 84, and the camera 70*b* is supported on the other x axis guide rail 84. By doing this, the camera 70*a* and the camera 70*b* are in a state arranged separated along the y axis direction. With this embodiment, an example is shown of a state with the camera 70*a* arranged at the y axis direction downstream side, and the camera 70*b* at the y axis direction upstream side.

Next, we will describe the operating state of the printing device 1, specifically, the printing method (printing steps) using the printing device 1, while referring to FIG. 3 through FIG. 16. The cross-hatching in FIG. 13 to FIG. 16 (the same is also true for FIG. 17) means that printing has been implemented on the preceding printing area W1 or the following printing area W2.

Figure 3:
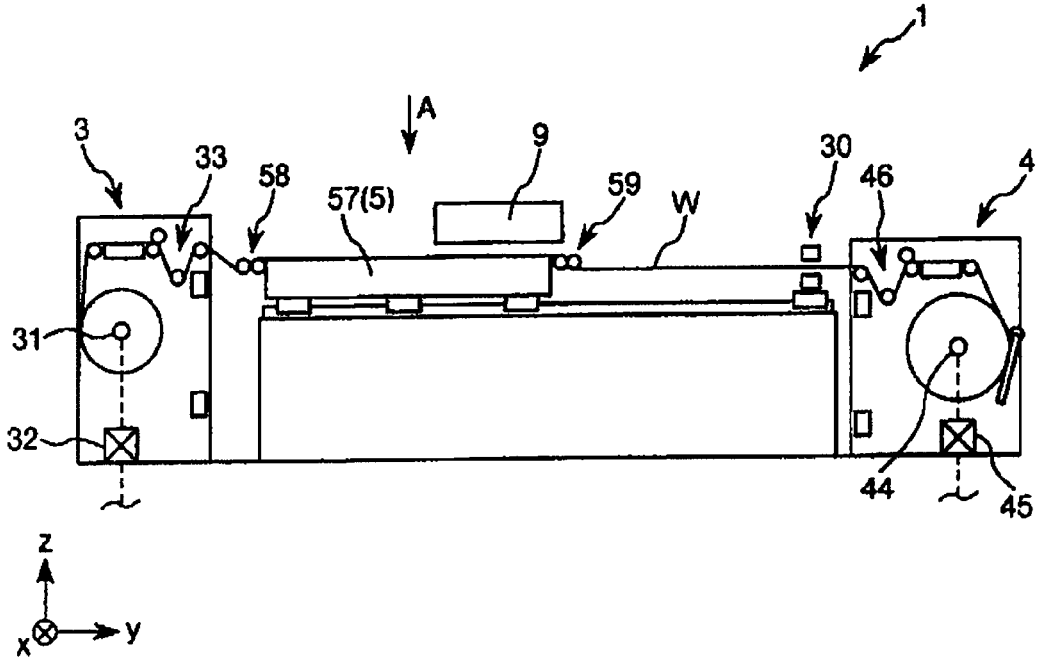
FIG. 3 is a side view showing the operating state in sequence of the printing device shown in FIG. 1.

(1) First, as shown in FIG. 3, the roll form work W is introduced to the delivery reel 31, and the tip part that has been delivered passes through the feed roller 58 and the outlet roller 59, and is connected to the winding reel 44. Then, the feed roller 58 and the outlet roller 59 are moved to the falling position, and the work stage 5 is moved to the printing start position. Also, as shown in FIG. 12, the preceding printing area W1 of the work W is held by suction on the work stage 5 (stage main unit 57) to be in a fixed state.

(2) Next, as shown in FIG. 4, the delivery motor 32 is driven, the work W of a length roughly equal to the moving distance of the work stage 5 is delivered, and the work W delivered to the delivery side buffer mechanism 33 is maintained.

(3) Next, designated printing is performed by discharging ink droplets from each inkjet head 91 on the preceding printing area W1 held by suction on the work stage 5 while scanning the carriage unit 9 in the x axis direction (print scan). After that, the work stage 5 (work W) is fed to the y axis direction downstream side (line feed) by the printing width amount with the printing scan. The printing scan and line feed is repeated a plurality of times, and printing is performed for the preceding printing area W1 part. When the printing operation for the preceding printing area W1 portion has ended, the work stage 5 reaches the printing end position (see FIG. 5).

Also, the work W maintained in the delivery side buffer mechanism 33 is pulled to the y axis direction downstream side along with movement to the work stage 5, and at the same time, the work W of the y axis direction downstream side of the work stage 5 is fed to the winding side buffer mechanism 46, and is maintained. During this execution, the delivery motor 32 and the winding motor 45 are not driven.

Figure 6:
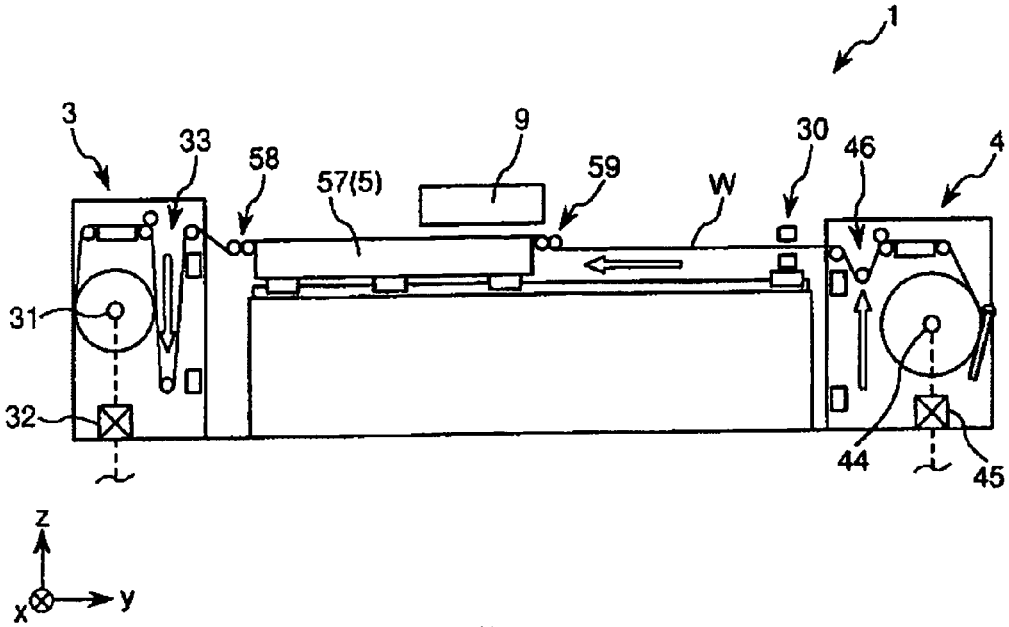
FIG. 6 is a side view showing the operating state in sequence of the printing device shown in FIG. 1.

(4) Next, as shown in FIG. 6, to perform the recording operation the second time on the preceding printing area W1, the work stage 5 facing the printing end position is moved to return to the printing start position. When the return movement is performed, the work W maintained in the winding side buffer mechanism 46 is pulled to the y axis direction upstream side along with movement to the work stage 5, and at the same time, the work W of the y axis direction upstream side of the work stage 5 is again fed to the delivery side buffer mechanism 33 and maintained. In this way, the work W fed to the upstream side can be absorbed by the delivery side buffer mechanism 33, so it is not necessary to wind the work W on the delivery reel 31 again. This kind of constitution is particularly effective when performing the printing operation a plurality of times as with this embodiment. With this embodiment, the printing operation is implemented two times on the preceding printing area W1, but the number of printing operations can be one time, or can be two or more times.

Figure 7:
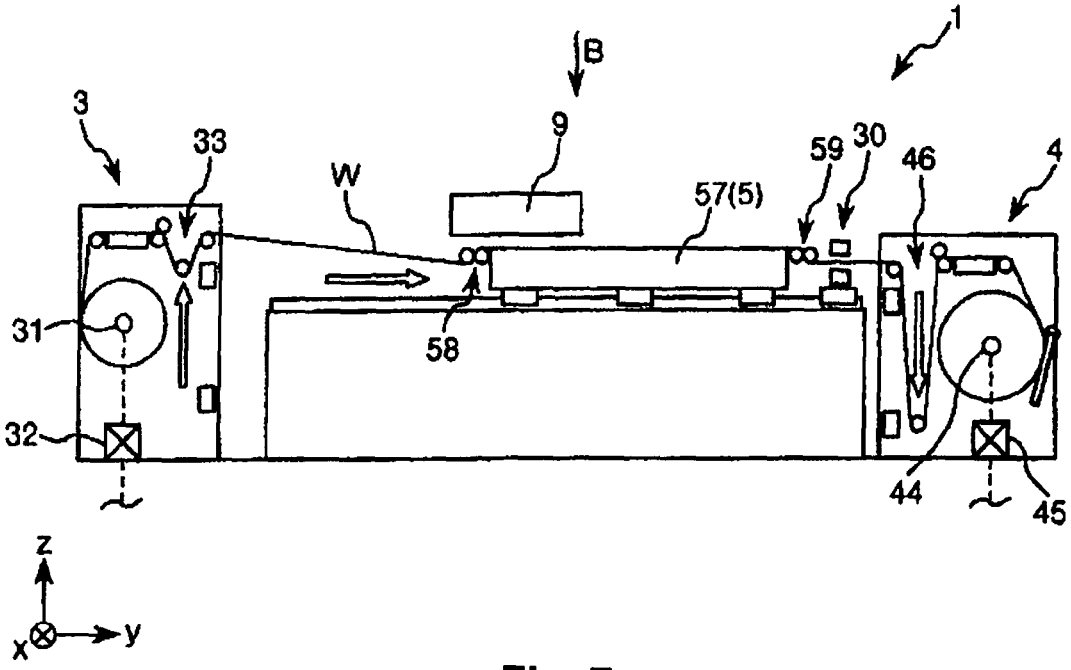
FIG. 7 is a side view showing the operating state in sequence of the printing device shown in FIG. 1.

(5) Next, as shown in FIG. 7, the printing operation is performed a second time on the preceding printing area W1 for which the first printing operation has ended. This operation is the same as the operation noted in (3) so we will omit a description here.

Also, as shown in FIG. 13, a marker of a "black circle" for example is added by printing as a preceding feature point P1 on the preceding printing area W1. The preceding feature point P1 is used to align the following printing area W2 to the carriage unit 9 when performing printing on the following printing area W2. This alignment allows printing to be implemented accurately on the following printing area W2.

Also, by the preceding feature point P1 being a marker added by printing, it is possible to add the preceding feature point P1 together with other printing within the preceding printing area W1. By doing this, it is possible to omit separately providing a step for adding the preceding feature point P1, and thus possible to rapidly perform printing with the printing device 1.

The position of the preceding feature point P1 is preferably a position separated 0 to 20 mm from the edge part of the preceding printing area W1, for example.

Figure 8:
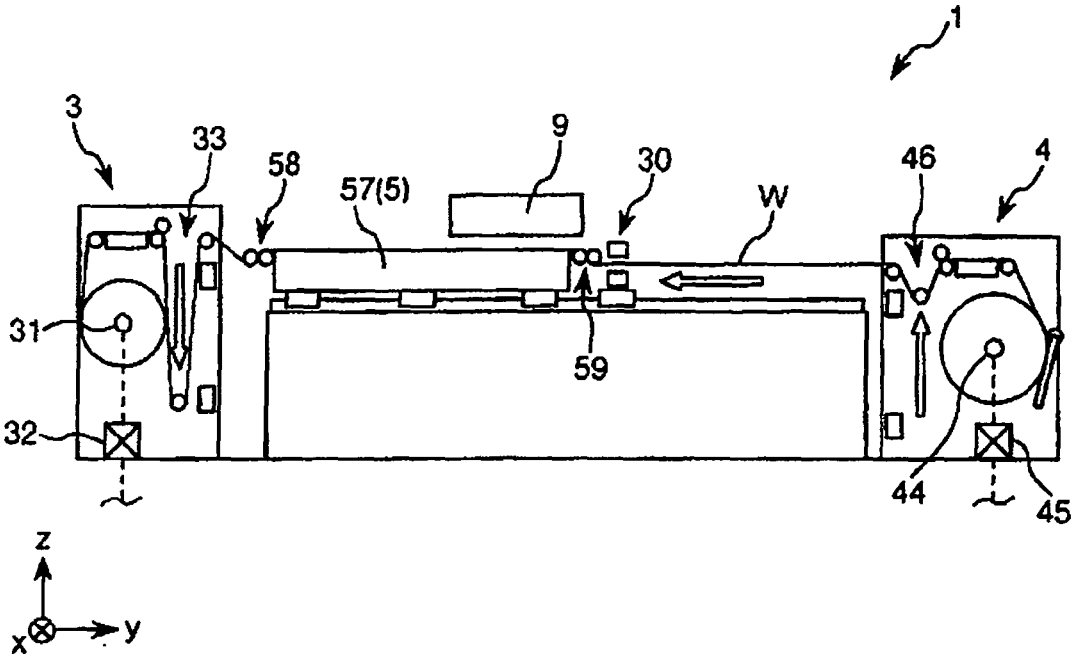
FIG. 8 is a side view showing the operating state in sequence of the printing device shown in FIG. 1.

(6) As shown in FIG. 8, the second recording operation ends, and the preceding printing area W1 facing the printing end position is moved to return to the printing start position again. When doing this return movement, the work holding device 30 is also moved in the printing start position direction. Specifically, the work holding device 30 is positioned near the downstream side of the outlet roller 59 of the work stage 5 moved to the printing start position.

Figure 9:
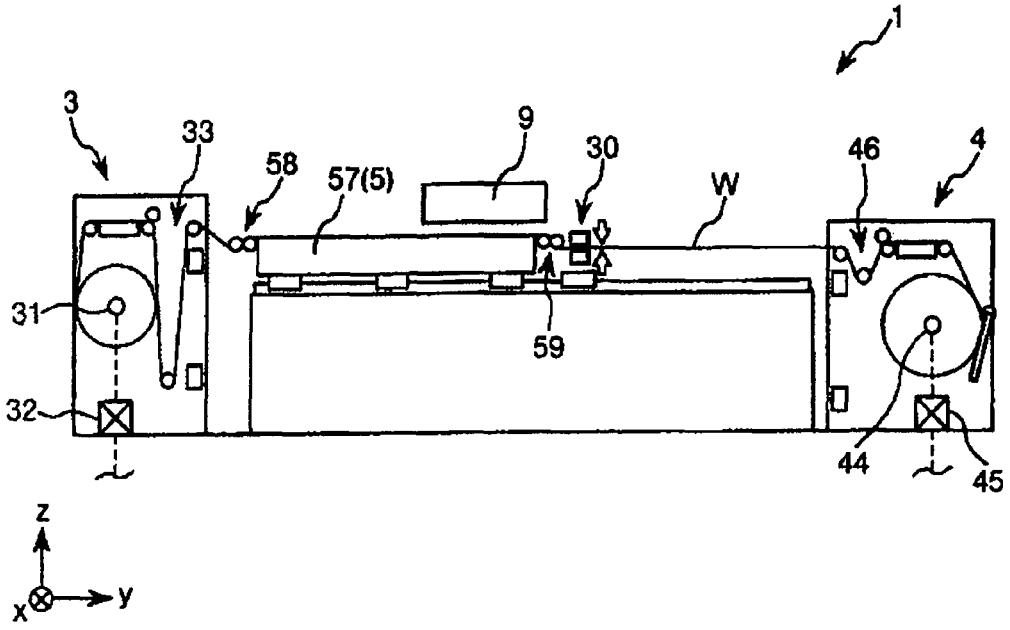
FIG. 9 is a side view showing the operating state in sequence of the printing device shown in FIG. 1.

(7) Next, as shown in FIG. 9, the work holding device 30 is driven, and the work W is sandwiched and held.

Figure 10:
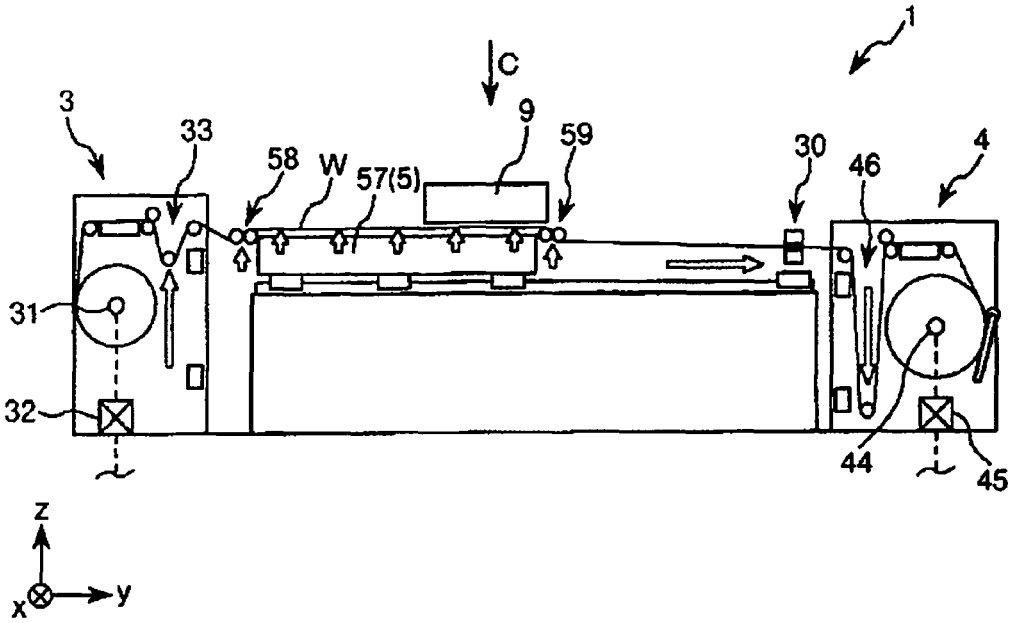
FIG. 10 is a side view showing the operating state in sequence of the printing device shown in FIG. 1.

(8) Next, as shown in FIG. 10, in a cancelled state for which the suction of the work W (preceding printing area W1) on the work stage 5 is cancelled (vacuum suction is stopped), compressed air is supplied, and the feed roller 58 and the outlet roller 59 are moved to the rising position. After that, the work stage 5 does not move, and the work holding device 30 is moved facing downstream. At this time, the already printed preceding printing area W1 on the work stage 5 is pulled to the y axis direction downstream side, and along with that, the pulled out amount of the work W is absorbed (held) on the winding side buffer mechanism 46. On the other hand, the work W maintained in the delivery side buffer mechanism 33 is facing the top of the pulled work stage 5. A portion of the work W facing the top of this work stage 5 becomes the following printing area W2.

Figure 11:
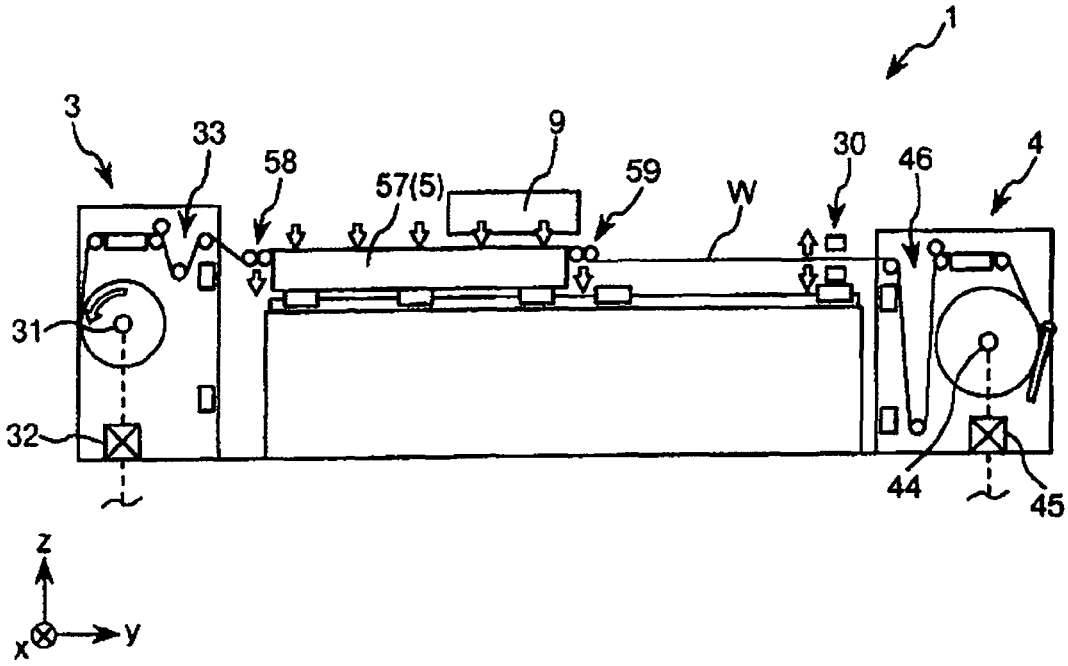
FIG. 11 is a side view showing the operating state in sequence of the printing device shown in FIG. 1.

(9) Next, as shown in FIG. 11, the feed roller 58 and the outlet roller 59 are moved to the falling position, and after the unrecorded following printing area W2 facing the top of the work stage 5 is suctioned and held to be in a fixed state, the gripping state of the work W by the work holding device 30 is cancelled. With this embodiment, immediately before or immediately after suctioning the work W to the work stage 5, the delivery motor 32 is driven in the winding direction, and the tension acting on the work W on the work stage 5 is adjusted.

(10) Then, the control device 60 drives the winding motor 45 and winds the work W maintained in the winding side buffer mechanism 46, and drives the delivery motor 32 to deliver the work W of roughly an equal amount to the movement distance of the work stage 5 to the delivery side buffer mechanism 33 (see FIG. 4). By doing this, it is possible to print on the following printing area W2.

However, when the already printed preceding printing area W1 of the operation (8) noted above is pulled to the y axis direction downstream side, the pulled amount may not be the y axis direction length amount of the preceding printing area W1. This is thought to be possibly due to the work W being in a long form, and there being high flexibility (pliability), for example. Then, in this case, as shown in FIG. 14, the work W is bent or curved, and the position of the following printing area W2 on the work stage 5 in relation to the carriage unit 9 is in a skewed state. In such a state, when printing is performed on the following printing area W2, for example it is possible that there will be an occurrence of overlap of the printing with the preceding printing area W1 and the printing with the following printing area W2, or there being wasted white space (unprinted area) between the preceding printing area W1 and the following printing area W2.

The control described below is effective in eliminating this kind of issue, and is performed between the operations (9) and (10) noted above.

When printing is implemented on the following printing area W2, before that printing, the work W is moved so that the preceding feature point P1 within the preceding printing area W1 overlaps with the target reference position P3 as much as possible. This target reference position P3 is stored in advance in the storage unit of the control device 60. Then, with one example shown in FIG. 14, the preceding feature point P1 is skewed by the skew volume Δy amount in the y axis minus direction in relation to the target reference position P3. Also, the following printing area W2 is tilted by an angle θ amount in relation to the y axis direction.

First, using the camera 70*a*, an image of the preceding feature point P1 is imaged as a gray scale image. Then, this image data is transferred to the control device 60, and binarization processing is performed with that control device 60. By doing this, the preceding feature point P1 is extracted, and the skew volume Δy between that extracted preceding feature point P1 and the target reference position P3 is found.

Also, using the cameras 70*a* and 70*b*, as the following feature point P2 with the following printing area W2, an image of the edge part positioned in the x axis direction of the following printing area W2 is imaged as a gray scale image. Then, this image data is transferred to the control device 60, and binarization processing is performed with that control device 60. By doing this, the following feature point P2 is extracted, and that extracted following feature point P2, specifically, the angle θ in relation to the y axis direction of the following printing area W2, is found.

As described previously, the cameras 70*a* and 70*b* are in a state arranged separated along the y axis direction. By doing this, it is possible to do imaging of the image of the following feature point P2 with as wide a range as possible, and thus, it is possible to accurately find the angle θ.

Next, as shown in FIG. 15, the relative positional relationship between the following printing area W2 and the carriage unit 9 is adjusted.

This adjustment is performed by moving the stage main unit 57 that is in a fixed state along the y axis direction for each work W (following printing area W2), and rotating this around the z axis using the stage support device 20. The movement volume in the y axis direction is the found skew volume Δy, and the rotating angle around the z axis is the angle θ found as noted above.

Then, by doing this adjustment, the preceding feature point P1 is arranged at the same position in the y axis direction in relation to the target reference position P3, and the skew volume Δy is eliminated. Also, with the following printing area W2, the lengthwise direction is parallel to the y axis direction, and the angle θ is eliminated.

With the printing device 1, by this adjustment, the preceding feature point P1 may overlap the target reference position P3 in some cases, but with this embodiment, the preceding feature point P1 is skewed by the skew volume Δx amount in the x axis position direction in relation to the target reference position P3. When the preceding feature point P1 overlaps the target reference position P3, it is possible to start printing on the following printing area W2.

When the preceding feature point P1 is skewed by the skew volume Δx amount, when printing on the following printing area W2, if the timing of starting the printing in the x axis direction of that carriage unit 9 is delayed by an amount of skew volume Δx (if displaced), it is possible to eliminate the skew volume Δx amount.

Then, in a state with the kind of positional adjustment noted above performed, if printing is started on the following printing area W2, as shown in FIG. 16, accurate, specifically, high precision printing is implemented on the following printing area W2.

When further implementing printing on the work W following the following printing area W2, the following printing area W2 becomes the "preceding printing area W1," and the printing area following the following printing area W2 becomes the "following printing area W2." The preceding feature point P1 is added on the following printing area W2 which became the "preceding printing area W1."

The work W on which printing is implemented with the printing step noted above is sent to the cutting step after that printing step. This cutting step is a step of cutting the work W for each printing area.

When the work W is cut at the boundary part W3 between the preceding printing area W1 and the following printing area W2, there are cases when it is difficult to know the boundary part W3 due to complexity of the pattern of the printing at each printing area or the like.

In this case, as shown in FIG. 17, the preceding feature point P1 also serves as the reference position during cutting, and the position separated by the distance $y_1$ amount in the y axis negative direction from that reference point can be regarded as the boundary part W3.

Then, if the cutting is done with the part regarded as the boundary part W3 as the cutting part, it is possible to accurately cut the work W into the preceding printing area W1 and the following printing area W2.

As an item used for cutting, though this is not particularly limited, for example, examples include scissors, an automatic cutter or the like.

Second Embodiment

Figures 18A, 18B, 18C:
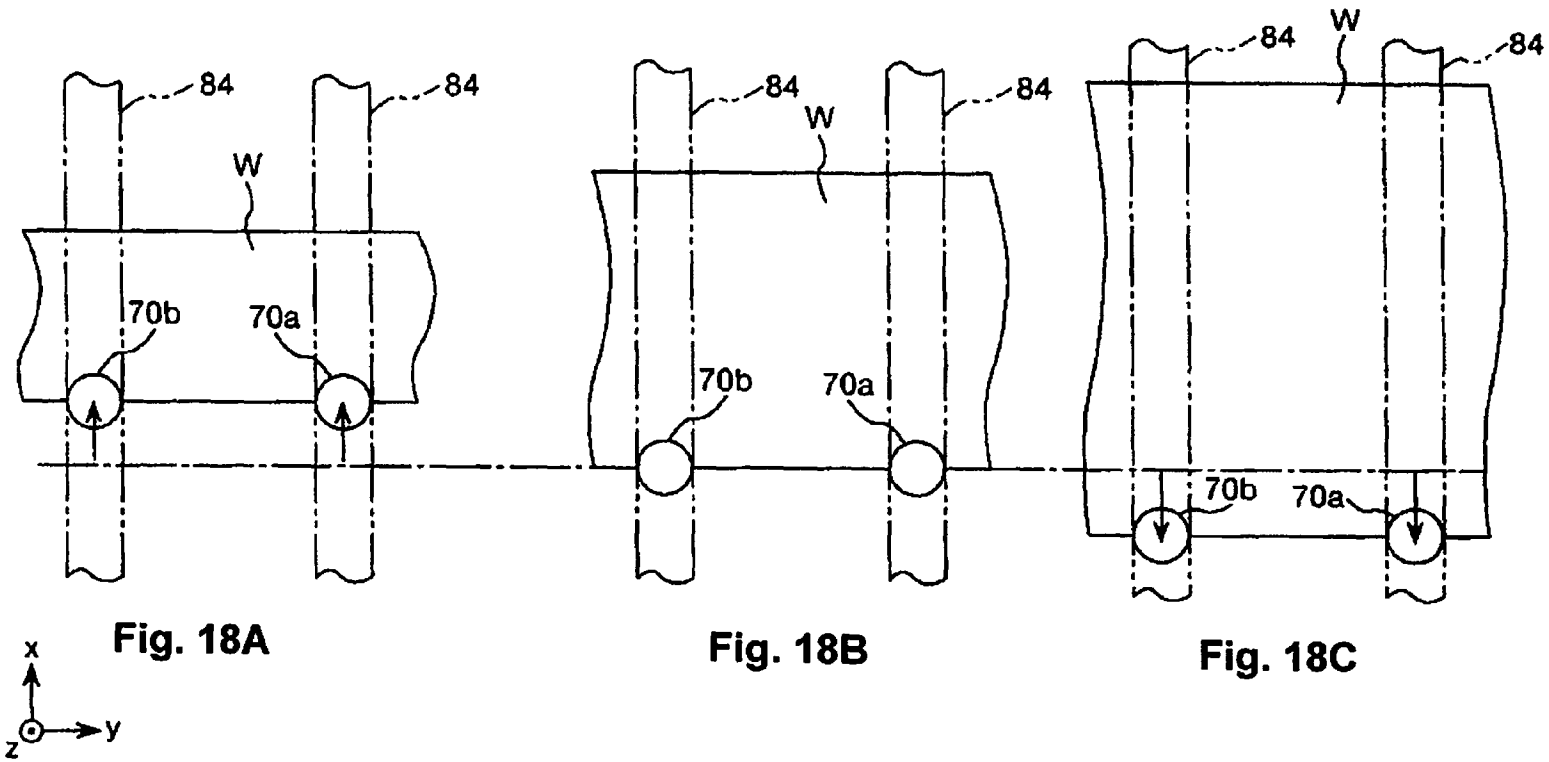
FIGS. 18A-C are plan views showing the second embodiment of the printing device of the present invention.

FIGS. 18A-18C are plan views showing the second embodiment of the printing device of the present invention.

Following, we will describe the second embodiment of the printing device and the printing method of the present invention while referring to this drawing, but we will focus the description on the difference points from the previously described embodiment, and will omit a description of same items.

This embodiment is the same as the first embodiment except that the support mode for supporting the x axis guide rail in relation to the camera is different.

As shown in FIGS. 18A-18C, each x axis guide rail (imaging unit supporting unit) is respectively constituted to as to support the cameras 70*a* and 70*b* to be able to move along the lengthwise direction, and the x axis direction. By doing this, it is possible to suitably adjust the position of the cameras 70*a* and 70*b* according to the work W width, specifically, the length in the x axis direction. By this adjustment, it is possible to reliably do imaging of an image of the preceding feature point P1 and the following feature point P2.

Above, we described the printing device and the printing method of the present invention with the embodiment in the drawing, but the present invention is not limited to this, and each part constituting the printing device can be replaced with an item of any constitution that is able to exhibit the same functions. It is also possible to add any constitution items. Also, the steps that the printing method has can be replaced with any steps that can exhibit the same function. It is also possible to add any steps.

Also, the printing device and the printing method of the present invention can be combined with any two or more constitutions (features) among those of each of the embodiments.

Also, the number of cameras arranged is two with each of the embodiments noted above, but the invention is not limited to this, and for example can also be one, or three or more.

Also, when adding a marker which is the preceding feature point using printing, the various conditions such as the shape, size, color and the like can be suitably changed according to the color of the foundation of the recording medium. By doing this, the preceding feature point stands out, and thus, extraction of the preceding feature point with the printing device is performed easily and reliably.

Also, the preceding feature point was a marker added using printing with each of these embodiments, but the invention is not limited to this, and for example it is also possible to have the marker or the like given by having a part of the recording medium missing.

Also, the correction of the skew volume $\Delta x$ in the x axis direction adjusted the start of printing, but the same as with the correction of skew in the y axis direction, it is also possible to adjust by moving the stage main unit 57 in the x axis direction.

Also, the angle $\theta$ was found from the following feature point P2, but when the angle $\theta$ cannot be found accurately because the image fetching range of P2 is narrow or the like, or because it is from only P2, it is possible to determine the angle $\theta$ from the information of both the following feature point P2 and the preceding feature point P1.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

an outlet roll configured to let out a recording medium having an elongated shape;

a winding roll configured to wind the recording medium and arranged downstream in a conveyance direction in which the recording medium is let out and conveyed in relation to the outlet roll;

a stage arranged between the outlet roll and the winding roll, the stage being configured to be in a fixed state for which the recording medium is fixed, and a cancelled state for which the fixed state has been cancelled;

a stage support unit supporting the stage such that the stage moves along at least a y axis direction of surface directions on the stage, when a direction orthogonal to the conveyance direction is used as an x axis direction, a direction parallel to the conveyance direction is used as the y axis direction, and a direction orthogonal to both the x axis direction and the y axis direction is used as a z axis direction;

a printing unit configured to, in the fixed state, divide the recording medium into a preceding printing area and a following printing area along the y axis direction, and perform printing in the sequence of the preceding printing area and the following printing area, the printing unit being further configured to perform printing a preceding feature point in the preceding printing area while performing the printing of the preceding printing area;

an extraction unit configured to extract the preceding feature point and extract an edge line in the conveyance direction of the following printing area, the edge line extending from a front edge to a rear edge in the conveyance direction of the following printing area and corresponding to an edge of the recording medium; and a controller configured to adjust a relative positional relationship of the printing unit and the following printing area based on the preceding feature point and the edge line extracted by the extraction unit after performing of the printing of the preceding printing area and the preceding feature point has ended and before printing of the following printing area starts.

2. The printing device according to claim 1, wherein an adjustment of the positional relationship is performed by having the stage in the fixed state moved along the y axis direction by the stage support unit.

3. The printing device according to claim 1, wherein the stage is rotatably supported around the z axis by the stage support unit, and an adjustment of the positional relationship is performed by having the stage in the fixed state rotated around the z axis by the stage support unit.

4. The printing device according to claim 1, further comprising a printing unit support unit configured to support the printing unit such that the print unit moves along the x axis direction, wherein an adjustment of the positional relationship is performed by skewing a timing for starting the printing of the printing unit.

5. The printing device according to claim 1, wherein of adjustments of positional relationship, an adjustment of the x axis direction positional relationship is based on the edge line extracted by the extraction unit, an adjustment of the y axis direction positional relationship is based on the preceding feature point extracted by the extraction unit, and an adjustment of the positional relationship around the z axis is based on the edge line extracted by the extraction unit.

6. The printing device according to claim 1, wherein the preceding feature point is a marker added to the preceding printing area.

7. The printing device according to claim 6, wherein the preceding feature point further serves as a reference position when the recording medium is cut between the preceding printing area and the following printing area.

8. The printing device according to claim 1, wherein the extraction unit has at least one imaging unit configured to capture an image of the preceding feature point.

9. The printing device according to claim 8, wherein a plurality of imaging units are arranged separated along the y axis direction.

10. The printing device according to claim 8, further comprising an imaging unit supporting unit configured to support the imaging unit such that the imaging unit moves in the x axis direction.

11. The printing device according to claim 1, further comprising a storage unit storing a target reference position, wherein the controller is configured to move the stage support unit supporting the stage on which the following printing area is fixed such that the preceding feature point approaches the target reference position.

* * * * *